US007249476B2

(12) United States Patent
Wilson et al.

(10) Patent No.: US 7,249,476 B2
(45) Date of Patent: Jul. 31, 2007

(54) METHOD AND APPARATUS FOR LOCKING A CONTAINER

(75) Inventors: Randy Wilson, Elkhart, IN (US); Kenneth Lemberger, Imperial, MO (US)

(73) Assignee: M-3 and Associates, Inc., Elkhart, IN (US)

( * ) Notice: Subject to any disclaimer, the term of this patent is extended or adjusted under 35 U.S.C. 154(b) by 17 days.

(21) Appl. No.: 11/037,519

(22) Filed: Jan. 18, 2005

(65) Prior Publication Data

US 2006/0156768 A1 Jul. 20, 2006

(51) Int. Cl.
*E05B 65/00* (2006.01)

(52) U.S. Cl. ..... 70/94; 70/56; 70/101; 70/163; 70/DIG. 64

(58) Field of Classification Search ..... 70/14, 70/58, 94, 101, 163–164, 209, 54–56, DIG. 64, 70/DIG. 65, DIG. 66; 292/259 R, 262, 269, 292/DIG. 53
See application file for complete search history.

(56) References Cited

U.S. PATENT DOCUMENTS 3,752,518 A * 8/1973 Cannell ..... 292/259 R
3,843,174 A 10/1974 Bogunovich et al.
3,866,961 A 2/1975 List
4,120,183 A 10/1978 Walters
4,120,415 A 10/1978 Hopkins et al.
4,135,376 A 1/1979 Evans et al.
4,580,818 A 4/1986 Lyng
4,765,664 A 8/1988 Siegel
5,010,747 A * 4/1991 Norden, Jr. ..... 70/94
5,022,697 A * 6/1991 Hettwer ..... 70/238
5,340,172 A * 8/1994 Sweet ..... 292/259 R
5,353,206 A 10/1994 Fejes
5,360,246 A 11/1994 Leiter et al.

(Continued)

FOREIGN PATENT DOCUMENTS

EP 1338736 8/2003

(Continued)

OTHER PUBLICATIONS

American Bicycle Security Company—Bicycle Lockers and Racks http://www.ameribike.com/catalog/bike/locker-intro.html.

(Continued)

*Primary Examiner*—Suzanne Dino Barrett
*Assistant Examiner*—Christopher Boswell
(74) *Attorney, Agent, or Firm*—Barnes & Thornburg LLP

(57) ABSTRACT

A method and apparatus for locking a container. The present disclosure relates to a lock mechanism which comprises a latch assembly having a rod and an extension including a latch aperture, wherein the extension extends from the rod to position the latch aperture away from the rod. The lock mechanism further comprises a door assembly having a door aperture. Additionally, a support assembly is adjustably coupled to the latch assembly wherein the support assembly includes at least one arm which supports the latch aperture in alignment with the door aperture. The method for locking the container comprises adjustably coupling the support assembly to the latch assembly and attaching the support assembly to mount assemblies which are releasably attached to internal walls of the container. The door is moved to a closed position to position the door aperture adjacent to the latch assembly wherein the extension is in alignment with the door aperture to receive a lock.

19 Claims, 7 Drawing Sheets

U.S. PATENT DOCUMENTS

| | | | | | |
|---|---|---|---|---|---|
| 5,419,165 | A * | 5/1995 | Perkins | 70/14 |
| 5,447,046 | A | 9/1995 | Duffus | |
| 5,466,023 | A * | 11/1995 | Williamson | 292/259 R |
| 5,622,397 | A | 4/1997 | Rice et al. | |
| 5,806,351 | A * | 9/1998 | Learnahan | 70/56 |
| 5,873,273 | A | 2/1999 | Vick | |
| 5,927,107 | A * | 7/1999 | Mitchell | 70/14 |
| 6,065,314 | A | 5/2000 | Nicholson | |
| 6,393,879 | B1 * | 5/2002 | William | 70/164 |
| 6,530,247 | B2 | 3/2003 | Moores | |
| 6,592,155 | B1 | 7/2003 | Lemley et al. | |
| 6,615,623 | B1 | 9/2003 | Ormerod | |
| 6,619,708 | B1 * | 9/2003 | Naylor | 70/14 |
| 6,655,762 | B2 | 12/2003 | Krueger | |
| 6,675,615 | B1 | 1/2004 | Williams | |
| 6,685,285 | B1 | 2/2004 | Fromme et al. | |
| 6,829,914 | B2 * | 12/2004 | Bullock | 70/14 |
| 6,834,896 | B2 * | 12/2004 | Smith | 70/14 |
| 2002/0017520 | A1 | 2/2002 | Smith | |
| 2002/0020706 | A1 | 2/2002 | Smith | |
| 2002/0108410 | A1 | 8/2002 | Webb et al. | |
| 2002/0179606 | A1 | 12/2002 | Houk, Jr. et al. | |
| 2003/0067176 | A1 | 4/2003 | Stevens et al. | |
| 2004/0173614 | A1 | 9/2004 | Rosler | |

FOREIGN PATENT DOCUMENTS

| | | |
|---|---|---|
| GB | 2 228 516 | 8/1990 |
| JP | 04096712 | 3/1992 |
| JP | 05213388 | 8/1993 |
| WO | WO2004014764 | 2/2004 |

OTHER PUBLICATIONS

New Well Plugs Have No Locks! http://www.enviroequip.com/quipnotes/newwellplugs.htm.

* cited by examiner

METHOD AND APPARATUS FOR LOCKING A CONTAINER

BACKGROUND

The present disclosure relates to a method and apparatus for locking a container. In particular, the present disclosure relates to a lock mechanism which is internally located within the container so as not to be exposed to tampering. Additionally, the present disclosure relates to a lock mechanism which is adjustable to accommodate a variety of sizes of containers.

SUMMARY

The present disclosure comprises one or more of the following features or combinations thereof disclosed herein or in the detailed description below.

The present disclosure relates to a lock mechanism which comprises a latch assembly having a rod and an extension including a latch aperture, wherein the extension extends from the rod to position the latch aperture away from the rod. The lock mechanism further comprises a door assembly having a door aperture. Additionally, a support assembly is adjustably coupled to the latch assembly wherein the support assembly includes at least one arm which supports the latch aperture in alignment with the door aperture.

The present disclosure also relates to a method of locking a container comprising attaching mount assemblies to internal walls of the container. Next, the door assembly is connected to a door of the container to position the door aperture through the door. The user then adjustably couples the support assembly to the latch assembly and attaches the support assembly to the mount assemblies. The user then moves the door to a closed position to position the door aperture adjacent to the latch assembly wherein the extension is in alignment with the door aperture and the latch aperture is adapted to receive a lock.

Additional features of the present disclosure will become apparent to those skilled in the art upon consideration of the following detailed description of illustrative embodiments of the disclosure.

BRIEF DESCRIPTION OF THE DRAWINGS

The detailed description particularly refers to the accompanying figures in which.

DETAILED DESCRIPTION

Figure 1:
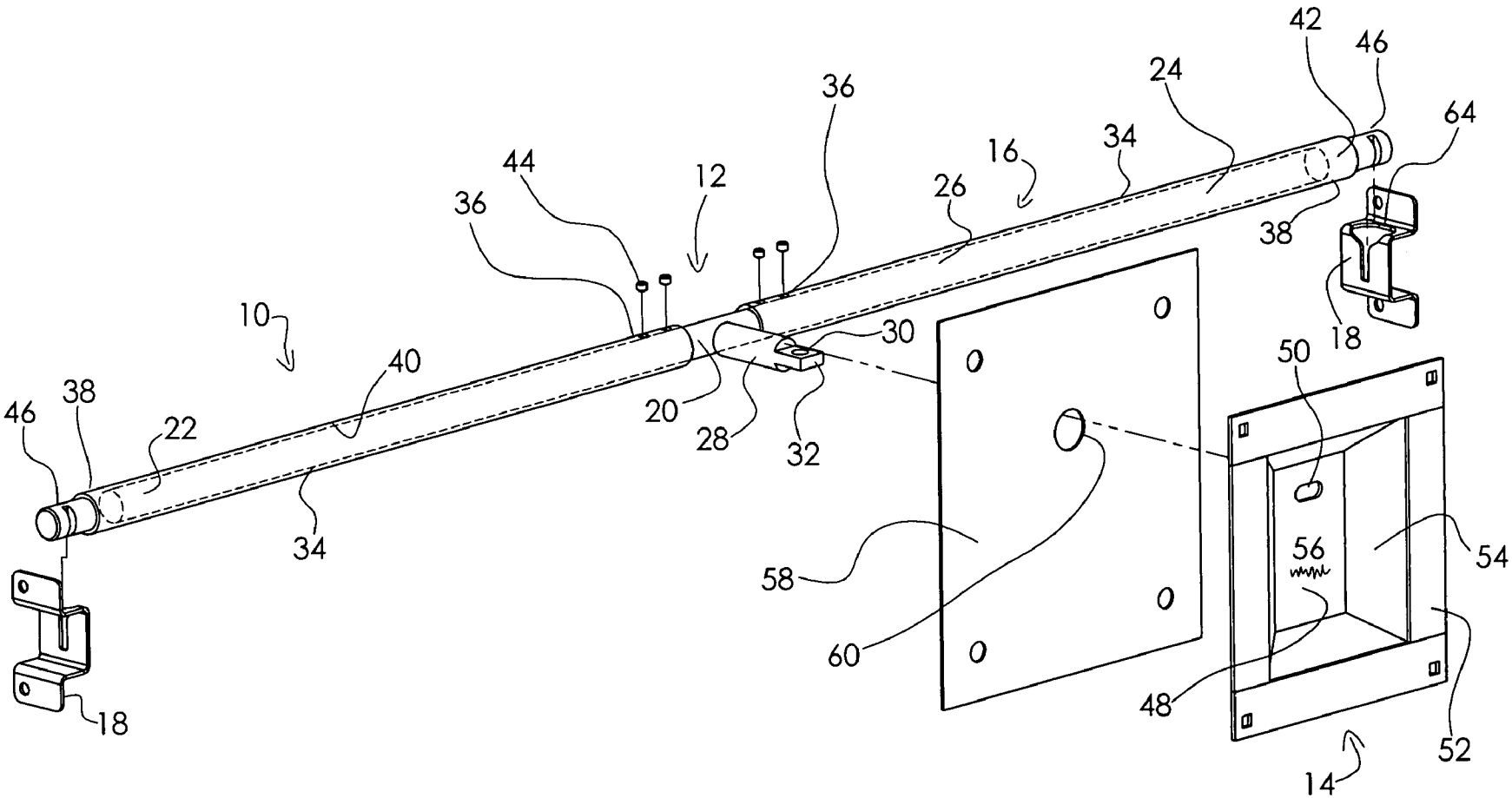
FIG. 1 is a breakaway perspective view of the lock mechanism of the present disclosure illustrating the latch assembly, the door assembly, the support assembly and the mount assembly.

While the present disclosure may be susceptible to embodiments in different forms, there is shown in the drawings, and herein will be described in detail, embodiments with the understanding that the present description is to be considered an exemplification of the principles of the disclosure and is not intended to limit the disclosure to the details of construction and the number and arrangements of components set forth in the following description or illustrated in the drawings.

FIG. 1 illustrates a lock mechanism 10 of the present disclosure in a breakaway perspective view. The lock mechanism 10 comprises a latch assembly generally shown as 12, a door assembly generally shown as 14, a support assembly generally shown as 16 and a mount assembly generally shown 18. The latch assembly 12 includes an elongate generally linear rod 20 having opposing first and second ends 22, 24 and a generally linear central axis 26. The latch assembly 12 further includes an extension 28 positioned between the ends 22, 24 of the rod 20. The extension 28 is attached to and extends generally perpendicularly and outwardly from the rod 20. The extension 28 includes a latch aperture 30 spaced apart from the rod 20. As shown, the latch aperture 30 is integrally formed within a tab 32 at the outer end of the extension 28.

The support assembly 16 includes at least one arm 34 that extends generally linearly between a first arm end 36 and a second arm end 38. The arm 34 has an interior surface 40 defining a hollow open-end chamber 42 within the arm 34. The hollow chamber 42 is sized larger than each end 22, 24 of the rod 20. In an embodiment, the hollow chamber 42 is sized to receive either of the ends 22, 24 such that the arm 34 is selectively slideable with respect to the rod 20 along the axis 26. As such, when either end 22, 24 of the rod 20 is located within the hollow chamber 42, the arm 34 may be selectively moved toward or away from the extension 28 along the axis 26. The arm 34 may comprise a tubular member adapted to slideably receive the rod 20. Alternatively, the rod 20 may comprise a tubular member adapted to slideably receive the arm 34.

The support assembly 16 includes one or more fasteners 44 which releasably secure the arm 34 to respective end 22, 24. Since the arm 34 is configured for relative movement along either end 22, 24, the fasteners 44 may selectively secure the arm 34 at any one of a plurality of positions along either end 22, 24. In an embodiment, the support assembly 16 may include a pair of arms 34 with respective hollow open-end chambers 42. Each arm 34 may be adjustably coupled to respective opposing ends 22, 24 of the rod 20 for relative movement with respect to each other along the axis 26 and with respect to the extension 28. As such, the fasteners 44 may releasably secure each arm 34 at any one of a plurality of different positions along each respective end 22, 24 of the rod 20.

The support assembly 16 further includes a connector 46 at the second arm end 38 of each arm 34. In an embodiment, the connector 46 may comprise an end component such as a lug welded to the second arm end 38 of the arm 34. Still further, in an embodiment, the connector 46 may be formed or machined from the second arm end 38 of the arm 34. The connector 46 may include one or more grooves adapted to connect with the mount assembly 18 as will be discussed.

The door assembly 14 of the lock mechanism 10 includes a wall 48 having a door aperture 50 which is configured larger in size than the tab 32 of the extension 28. The door assembly 14 further includes a mounting surface 52 and recess walls 54, wherein the recess walls 54 extend from the mounting surface 52 toward the wall 48 and door aperture 50 to form a recess 56. The door assembly 14 may also include a reinforcing plate 58 having a plate aperture 60 that is aligned with the door aperture 50.

The mount assembly 18 of the lock mechanism 10 is configured to releasably attach to a first container 62 (FIG. 5), wherein the mount assembly 18 may have a variety of configurations such as a bracket. The mount assembly 18 includes an opening 64, such as for example an open-end slot, which is adapted to receive the connector 46 of the support assembly 16 as will be discussed.

The latch assembly 12 and the support assembly 16 may have a variety of cross sectional configurations including but not limited to cylinders, rectangles or tubes. Additionally, the latch assembly 12, the support assembly 16 and the mount assembly 18 may comprise a variety of durable materials including but not limited to hardened steel. The door assembly 14 may also comprise a variety of durable and weather resistant materials.

Figure 2:
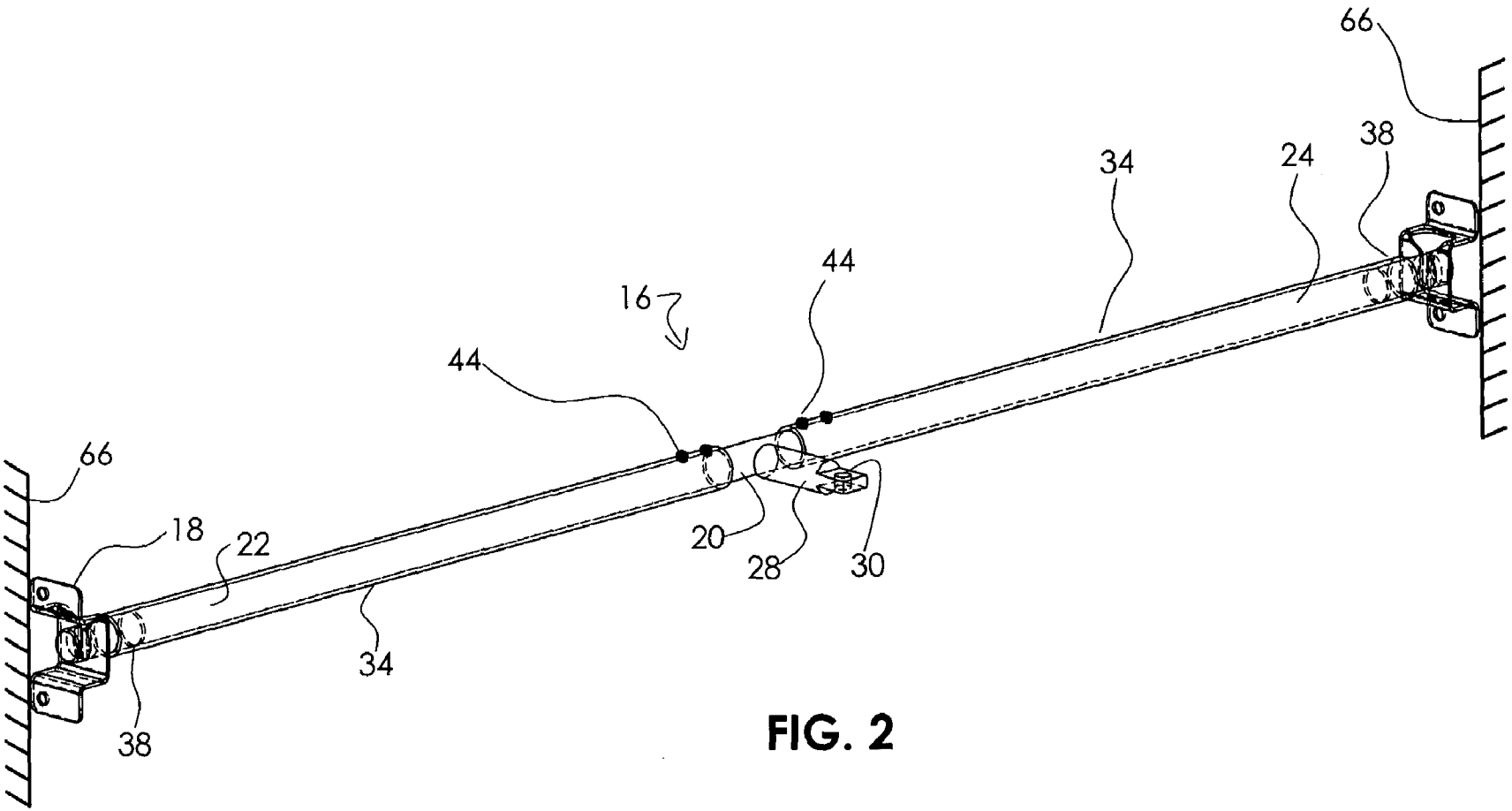
FIG. 2 is a perspective view of the latch assembly positioned within the support assembly illustrating the support assembly in a retracted position.
Figure 3:
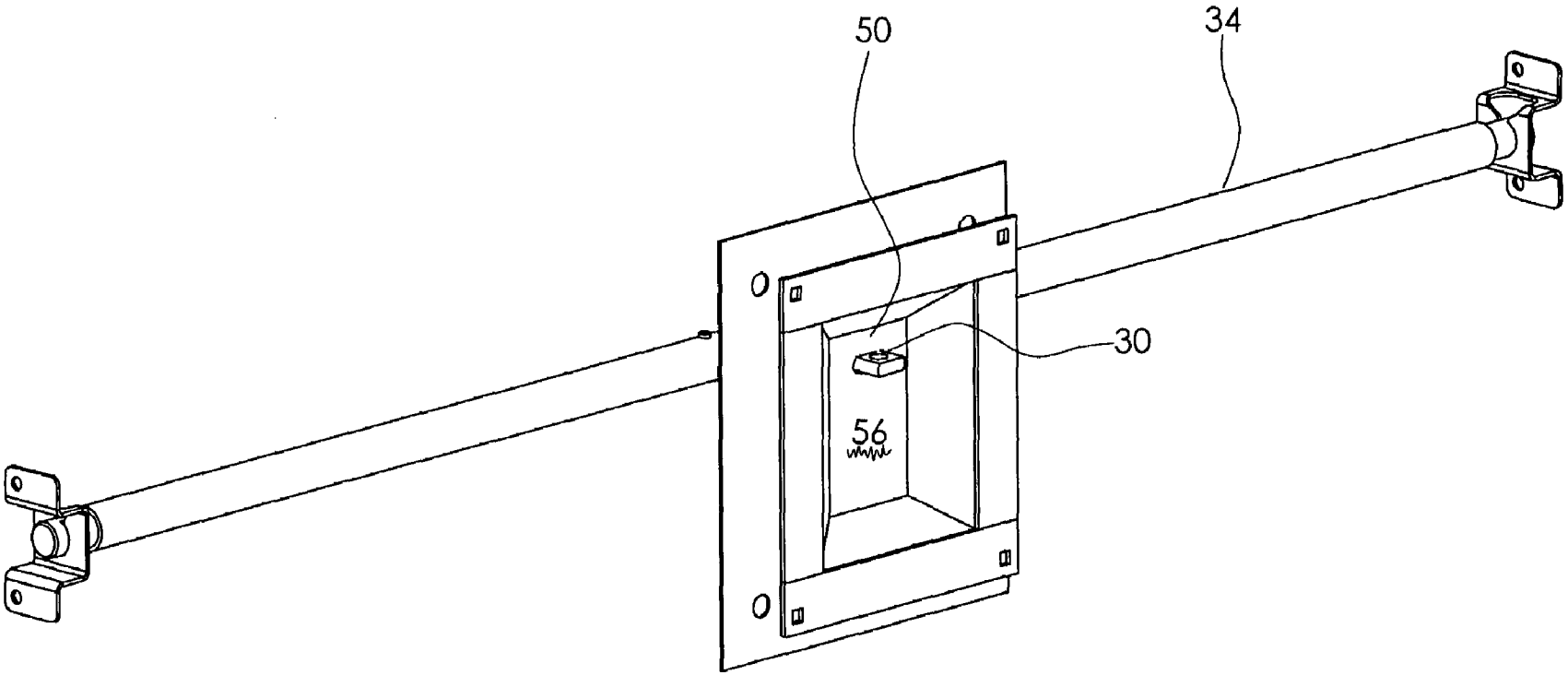
FIG. 3 is a perspective view of a latch aperture of the latch assembly positioned through a door aperture of the door assembly.
Figure 5A:
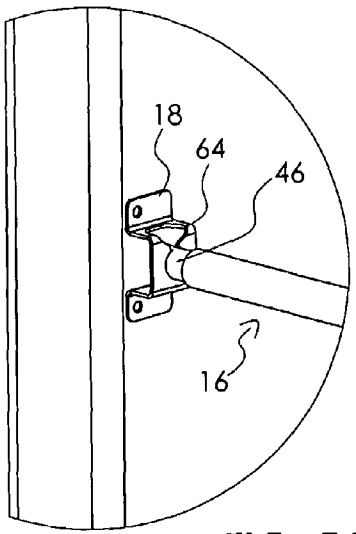
FIG. 5*a* is a partial view of FIG. 5 showing the support assembly releasably attached to the mount assembly.
Figure 5:
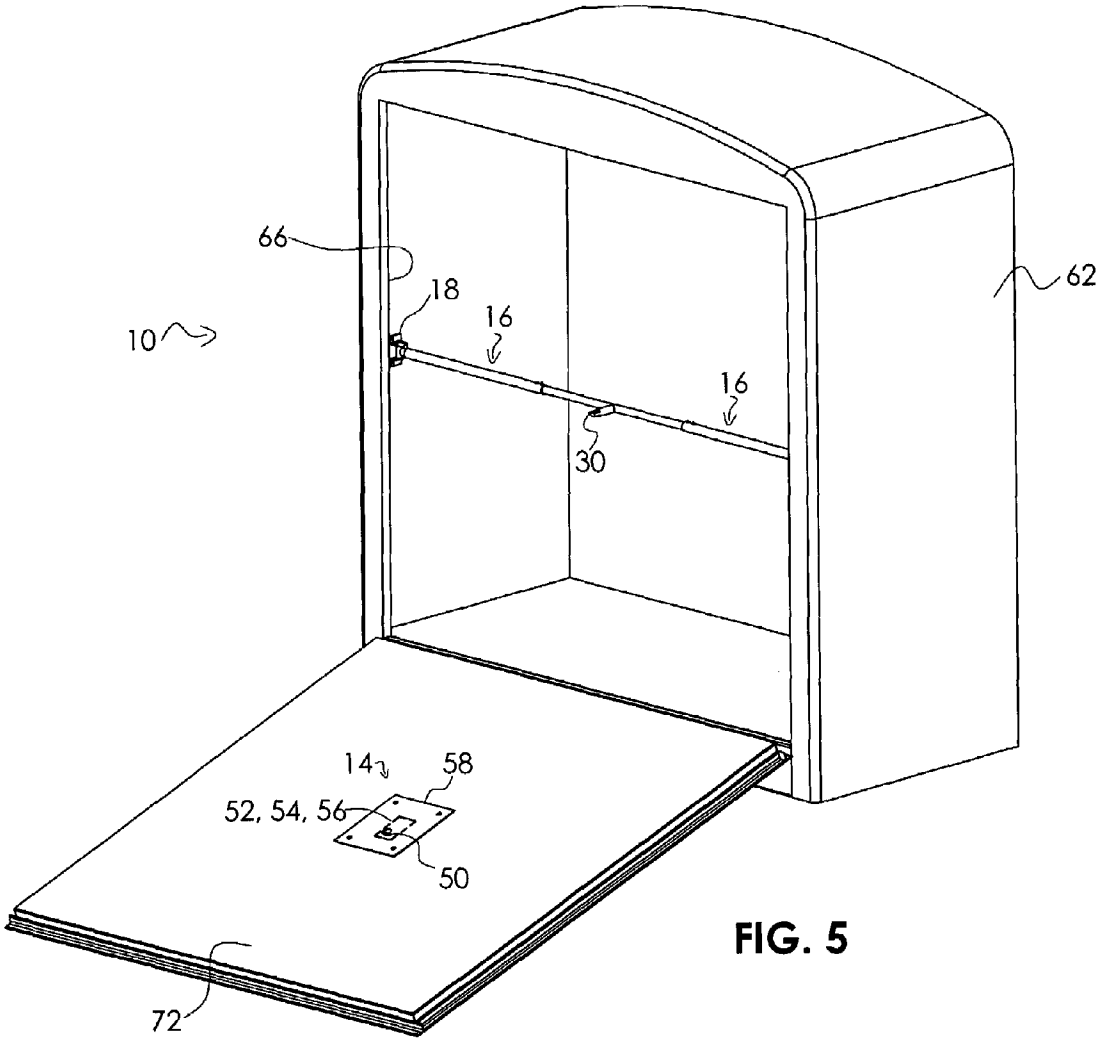
FIG. 5 is a perspective view of the lock mechanism of the present disclosure internally positioned within the container having a door shown in an open position.

Turning to FIG. 2, the support assembly 16 is shown with each arm 34 in a retracted position. The second arm end 38 of each arm 34 is releasably attached to the mount assembly 18 which, in turn, is releasably attached to an internal wall 66 of the container 62 (FIG. 5). Since the arms 34 are selectively positionable along the respective ends 22, 24 of the rod 20 between fully retracted and fully extended positions, the arms 34 of the support assembly 16 may support and position the extension 28 and latch aperture 30 at any selected one of a plurality of positions from the mount assembly 18. In an embodiment, at least one arm 34 supports the latch aperture 30 in alignment with the door aperture 50 as shown in FIG. 1. Turning to FIG. 3, the at least one arm 34 supports the latch aperture 30 such that the latch aperture 30 extends through the door aperture 50 and the latch aperture 30 is located in the recess 56 of the door assembly 14. A lock 70 (FIG. 7) may be removably attached to the extension 28 through the latch aperture 30 when the aperture 30 is located in the recess 56. Returning to FIG. 2, while supporting the extension 28 and latch aperture 30, the support assembly 16 in combination with the latch assembly 12 extends between opposing internal walls 66 of the container 62.

Figure 4:
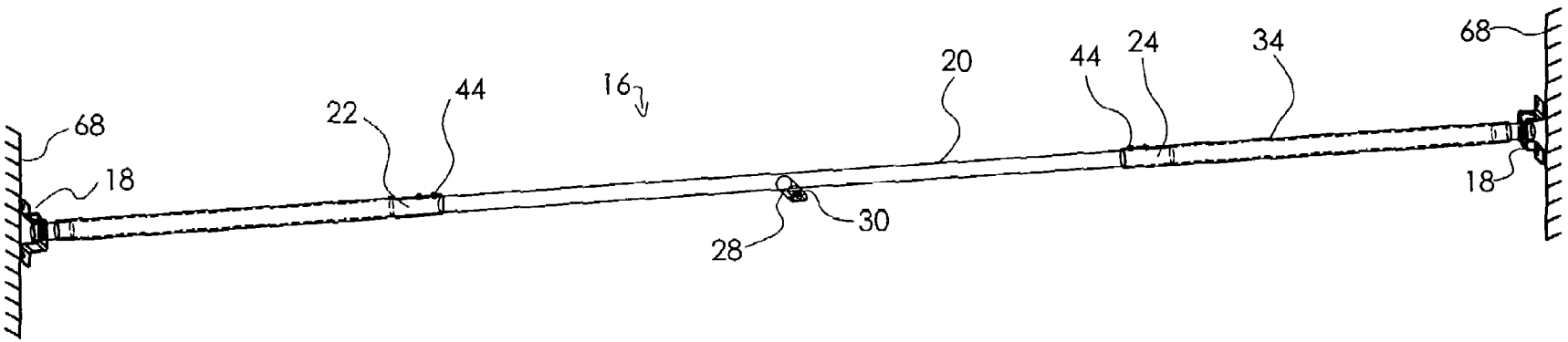
FIG. 4 is a perspective view of the latch assembly positioned within the support assembly illustrating the support assembly in an expanded position.

Turning to FIG. 4, the support assembly 16 is shown in an expanded or extended position with each arm 34 releasably attached to a mount assembly 18. Each mount assembly 18 is releasably attached to a respective internal wall 68 of a second container. Comparing FIGS. 2 and 4, the internal walls 68 are spaced apart wider than are the internal walls 66. The arms 34 are selectively moveable relative to the ends 22, 24 of the rod 20, such that the support assembly 16 may support and position the extension 28 and latch aperture 30 at any selected position of a plurality of positions and at a selected distance from the mount assembly 18. Regardless of the dimensions of the container and the distance between the opposing walls 66 or 68, the arms 34 may support and position the extension 28 and latch aperture 30 in alignment with the door aperture 50 (FIG. 1) and may support and position the extension 28 and latch aperture 30 in a position adapted to extend through and beyond the door aperture 50 (FIG. 3). As such, the lock mechanism 10 is selectively adjustable to fit different containers having different dimensions.

Turning to FIG. 5, the lock mechanism 10 is shown connected to the internal walls 66 of container 62. In particular, first and second mount assemblies 18 are releasably attached to each respective wall 66 and the support assembly 16 is releasably attached with each mount assembly 18. In an embodiment, the connector 46 of the support assembly 16 mates with the opening 64 of the mount assembly 18 as shown in FIG. 5*a*. Returning to FIG. 5, the lock mechanism 10 may traverse the width of the container 62 between the internal walls 66. The internal walls 66, though, are not limited to the sidewalls of the container 62, but the internal walls 66 may also include opposing top and bottom walls of the container 62. Accordingly, the lock mechanism 10 may traverse the height of the container 62 when the mount assembly 18 connects to the top and bottom internal walls.

As shown in FIG. 5, the door assembly 14 is connected to a door 72 of the container 62 wherein the door 72 is configured for pivotal movement about one edge between an open position and a closed position. Reinforcing plate 58 is positioned on an interior side of the door 72 while the mounting surface 52 and recess walls 54 are positioned on an exterior side of the door 72. As such, the recess 56 is positioned on the exterior side of the door 44.

When the door 72 is in the closed position, the support assembly 16 supports and positions the extension 28 and the latch aperture 30 such that the extension 28 extends through and beyond the door aperture 50 and such that the latch aperture 30 is located within the recess 56 wherein it is adapted to receive lock 70 as will be discussed. Accordingly, the support assembly 16 in combination with the latch assembly 12 may adjustably traverse the internal walls 66 of the container 62 to properly align the latch aperture 30 with the door aperture 50.

Figure 6:
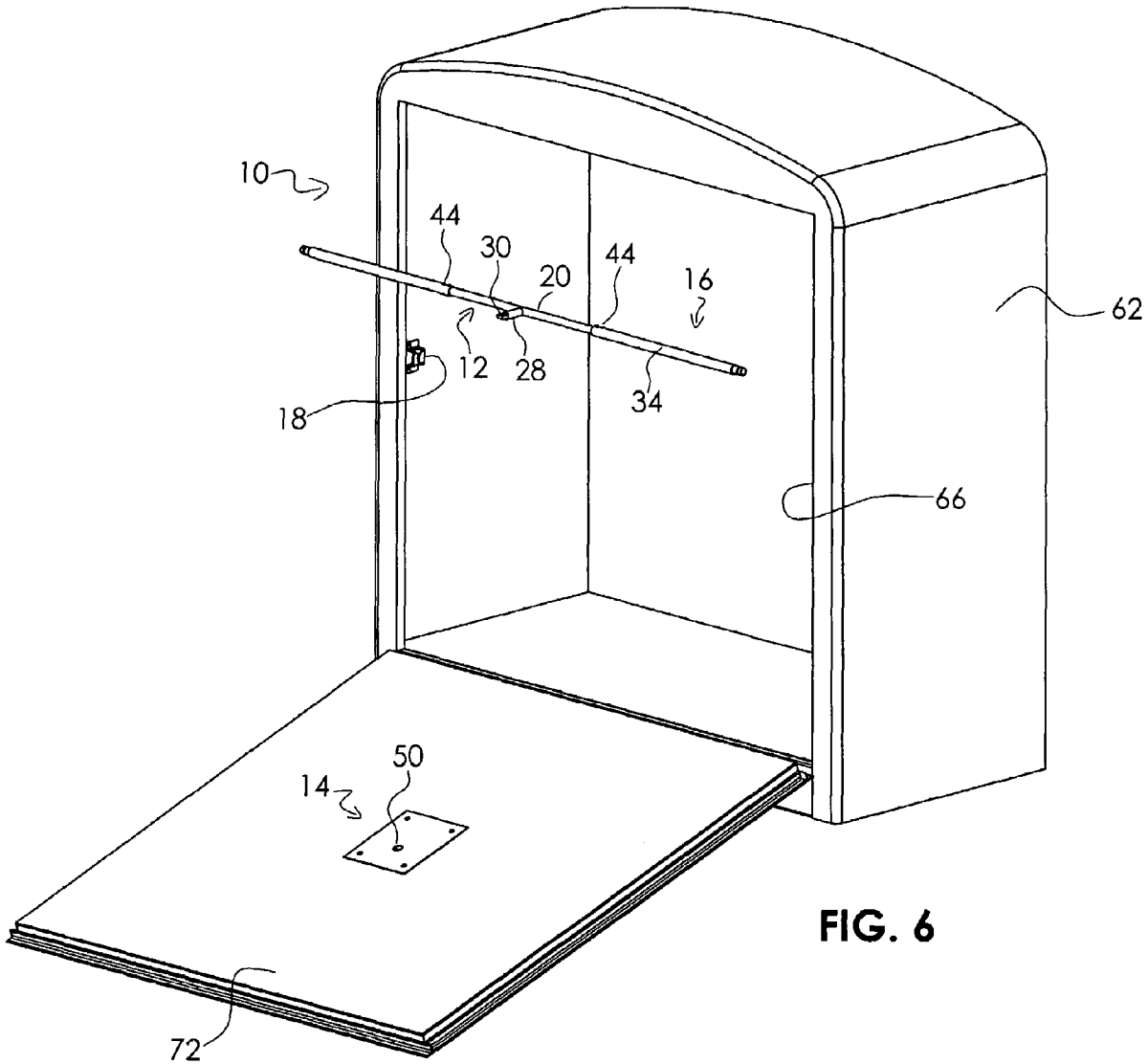
FIG. 6 is a perspective view showing the support assembly disconnected from the mount assembly which is connected to an internal wall of the container.

The lock mechanism 10 reduces exposure of the lock mechanism 10 to tampering as all of the lock mechanism 10, other than the tab 32, is located within the container 62 and behind the door 72, while being adjustable in size to fit a variety of container sizes. In use, the user may connect the door assembly 14 to the door 72 in a selected position such that the door aperture 50 extends through the door 72 as shown in FIG. 6. The door assembly 14 may be connected to the door 72 in a variety of fabrication methods. The user may remove a portion of the door 72 and may fasten or weld the door assembly 14 to the door 72. Since the mount assembly 18 may be removably attached to the internal walls 66 of the container 62 and the support assembly 16 adjustably positions the latch assembly 12 and latch aperture 30 between the internal walls 66 of the container 62, the door assembly 14 may be connected to the door 72 at any one of a plurality of locations as desired.

Once the door assembly 14 is installed, the user moves the door 72 from the open position to the closed position (FIG. 7) to measure the height of the door aperture 50 with respect to the internal walls 66 of the container 62. The user then connects the mount assemblies 18 to the internal walls 66 at an appropriate height as dictated by the height of the door aperture 50.

Next, the user inserts the latch assembly 12 into the support assembly 16. As previously noted, the latch assembly 12 includes the rod 20 and extension 28, wherein the extension 28 is positioned between the ends 22, 24 of the rod 20. The support assembly 16 meanwhile includes the arms 34 having a hollow open-end chamber 42. Each end 22, 24 of the rod 20 is slideably inserted into the open end of the hollow chamber 42 of a respective arm 34. Each arm 34 is selectively slideably along its associated rod end 22, 24 such that the second arm ends 38 of the arms 34 are spaced apart an appropriate distance wherein the connector 46 at each second arm end 38 is adapted to be releasably attached to a respective mount assembly 18. As such, the extension 28 and latch aperture 30 are positioned as desired between the second arm ends 38 of the arms 34 in order to align with the door aperture 50 of the door assembly 14 when the door 72 is closed.

Figure 7:
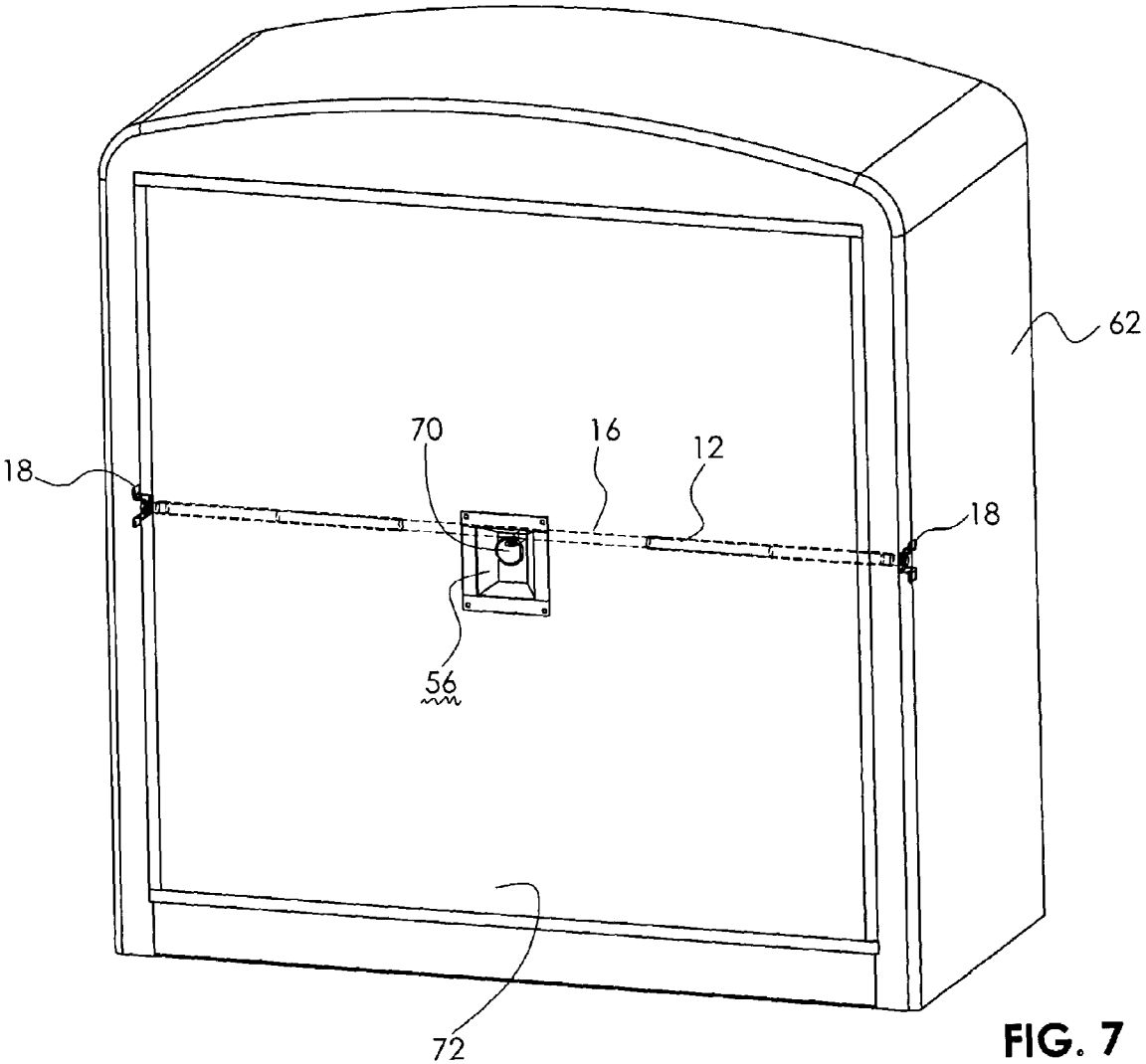
FIG. 7 is a perspective showing the lock mechanism internally positioned within the container with the door shown in a closed position.

The user then connects the support assembly 16 to the mount assemblies 18. In an embodiment, the user may mate the connector 46 of the arm 34 with the opening 64 of the mount assembly 18 as shown in FIG. 5*a*. The user then moves the door 72 to the closed position such that the tab 32 of the extension 28 extends through the door aperture 50 and such that the latch aperture 30 is located externally of the door aperture 50 within the recess 56 as shown in FIG. 7. The recess 56 is then exposed to the exterior of the container 62 to accept the lock 70, such as a puck lock, which is removably attached to the extension 28 through the latch aperture 30. As such, the lock 70 is positioned within the recess area 56 to prevent access behind the lock 70. The lock 70 and its coupling to the extension 28 prevent movement of the door 72 from the closed position toward the open position.

Accordingly, the user may adjust the position of the extension 28 and latch aperture 30 laterally with respect to the mount assembly 18 and door aperture 50 in order to conveniently align the extension 28 and latch aperture 30 with the door aperture 50. It should be known that the position of the extension 28 and latch aperture 30 may be adjusted vertically with respect to the mount assembly 18 and door aperture 50 when the mount assemblies 18 are connected to the top and bottom internal walls 66 of the container 62.

While the concepts of the present disclosure have been illustrated and described in detail in the drawings and foregoing description, such an illustration and description is to be considered as exemplary and not restrictive in character, it being understood that only the illustrative embodiment has been shown and described and that all changes and modifications that come within the spirit of the disclosure are desired to be protected by the claims set forth below.

The claimed invention is:

1. A lock mechanism and a container comprising:

a container having internal walls defining an essentially enclosed container cavity, a door on the container, the door having an aperture, a latch assembly including a rod inside the container and an extension extending outwardly from the rod, the extension defining a latch aperture, the rod having a first end and a second end, with each end configured for engagement to an internal wall of the container and a support assembly inside the container, the support assembly including a first arm adjustably coupled to the rod of the latch assembly, the first arm adapted to support the latch assembly and to position the extension of the latch assembly such that the rod is disposed within the container cavity and the extension is adapted to extend from inside the container cavity through the door aperture to outside the container cavity when the door is moved to a closed position to substantially enclose the container cavity whereby the latch aperture is adapted to removably receive a lock.

2. The lock mechanism of claim 1 wherein the extension of the latch assembly is located between a first end and a second end of the rod.

3. The lock mechanism of claim 1 wherein the first arm includes an inner surface defining a hollow chamber, an end of the rod being located within the hollow chamber of the first arm, the first arm being selectively slideable along the rod such that the first arm is selectively positionable with respect to the extension of the latch assembly.

4. The lock mechanism of claim 3 including one or more fasteners, the fasteners adapted to releasably secure the first arm in a fixed position relative to the rod.

5. The lock mechanism of claim 3 wherein the rod includes a generally linear central axis, the first arm being selectively slideable along the central axis of the rod.

6. The lock mechanism of claim 1 wherein the rod of the latch assembly includes a first end and a second end, the first arm of the support assembly being coupled to the first end of the rod, the support assembly including a second arm coupled to the second end of the rod, the first arm being selectively slideable along the first end of the rod such that the first arm is selectively positionable with respect to the extension of the latch assembly, and the second arm being selectively slideable along the second end of the rod such that the second arm is selectively positionable with respect to the extension of the latch assembly.

7. The lock mechanism of claim 1 wherein the first arm includes a first arm end and a second arm end, the second arm end of the first arm including a connector.

8. The lock mechanism of claim 7 including a mount assembly adapted to be releasably attached to a container, the connector of the first arm adapted to be releasably attached to the mount assembly.

9. A lock mechanism and a container comprising:

a container having internal walls defining an essentially enclosed container cavity, a latch assembly including a rod inside the container and an extension extending outwardly from the rod, the extension defining a latch aperture;

a door having an aperture;

a first mount assembly adapted to be releasably attached to a first internal wall of the container;

a second mount assembly adapted to be releasably attached to a second internal wall of the container; and a support assembly adjustably coupled to the latch assembly, the support assembly adapted to be releasably attached to the first and second mounting assemblies such that the rod is disposed within the container cavity and the extension is positioned to extend from within the container cavity through the door aperture of the door when the door is closed such that the latch aperture is adapted to receive a lock.

10. The lock mechanism of claim 9 wherein the support assembly includes a first arm having an inner surface defining a hollow chamber, an end of the rod being located within the hollow chamber of the first arm, the first arm being selectively slideably along the rod such that the first is selectively positionable with respect to the extension of the latch assembly.

11. The lock mechanism of claim 10 including one or more fasteners, the fasteners adapted to releasably secure the first arm in a fixed position relative to the rod.

12. The lock mechanism of claim 10 wherein the rod includes a generally linear central axis, the first arm being selectively slideably along the central axis of the rod.

13. The lock mechanism of claim 9 wherein the rod of the latch assembly includes a first end and a second end, the first arm of the support assembly being coupled to the first end of the rod, the support assembly including a second arm coupled to the second end of the rod, the first arm being selectively slideably along the first end of the rod such that the first arm is selectively positionable with respect to the extension of the latch assembly, and the second arm being selectively slideable along the second end of the rod such that the second arm is selectively positionable with respect to the extension of the latch assembly.

14. A method of locking a container having internal walls defining a container cavity, comprising:

connecting a door assembly to a door of the container, the door assembly defining a door aperture;

connecting two or more mount assemblies to the internal walls of the container;

coupling a support assembly to a latch assembly;

attaching the support assembly that is coupled to the latch assembly to the two or more mount assemblies so that the support assembly is disposed substantially within the container cavity; and then moving the door to a closed position to substantially enclose the container cavity wherein the latch assembly extends through the door aperture and is adapted to receive a lock.

15. The method of claim 14 including adjusting the position of the support assembly with respect to the latch assembly to provide proper alignment of the latch assembly with the door aperture.

16. The method of claim 15 including securing the support assembly to the latch assembly to prevent movement there between.

17. The method of claim 15 wherein the support assembly includes a first arm having an inner surface defining a hollow chamber and wherein the latch assembly includes a rod and an extension extending outwardly from the rod, and wherein adjusting the position of the support assembly comprises selectively sliding the first arm along the rod such that the first arm is selectively positionable with respect to the extension of the latch assembly.

18. The method of claim 15 wherein the support assembly includes a first arm and wherein the latch assembly includes a rod having a first end and a second end and the latch assembly includes an extension extending outwardly from the rod, and wherein adjusting the position of the support assembly comprises adjustably coupling the first arm to the first end of the rod and selectively sliding the first arm along the first end such that the first arm is selectively positionable with respect to the extension of the latch assembly.

19. The method of claim 18 wherein the support assembly includes a second arm, and wherein adjusting the position of the support assembly comprises adjustably coupling the second arm to the second end of the rod and selectively sliding the second arm along the second end such that the second arm is selectively positionable with respect to the extension of the latch assembly.

* * * * *